United States Patent [19]

McGrane

[11] Patent Number: 4,959,508

[45] Date of Patent: Sep. 25, 1990

[54] SUBMERSIBLE SPLICE APPARATUS

[75] Inventor: Eugene W. McGrane, Ormond Beach, Fla.

[73] Assignee: Homac Mfg. Company, Ormond Beach, Fla.

[21] Appl. No.: 389,478

[22] Filed: Aug. 4, 1989

[51] Int. Cl.[5] ..... H01R 4/20

[52] U.S. Cl. ..... 174/84 C

[58] Field of Search ..... 174/84 R, 84 C, 84 S, 174/90, 138 F; 16/108; 29/869, 871; 439/738, 750, 877, 880, 882

[56] References Cited

U.S. PATENT DOCUMENTS

| | | | |
|---|---|---|---|
| 1,291,460 | 1/1919 | Finley | 439/738 X |
| 2,674,647 | 4/1954 | Dibner | 439/880 X |
| 3,009,986 | 11/1961 | Stephens | 174/84 C |
| 3,173,989 | 3/1965 | Neaderland | 174/84 C |
| 3,213,186 | 10/1965 | Raila et al. | 174/84 C |
| 3,281,524 | 10/1966 | Lynch, Jr. et al. | 174/84 C |
| 3,404,216 | 10/1968 | Amann et al. | 174/84 C |

*Primary Examiner*—Laramie E. Askin

*Attorney, Agent, or Firm*—John E. Benoit

[57] ABSTRACT

A submersible splice assembly which provides a splice and a removable mating splice cover. The splice and splice cover are configured such that the splice cover is centered about the splice. The splice includes a centrally located rib extending about the splice and the splice cover includes a central recess which mates with the rib on the splice. An interference fit between the splice and splice cover is also provided.

4 Claims, 2 Drawing Sheets

SUBMERSIBLE SPLICE APPARATUS

This invention relates generally to splice covers and more particularly to submersible splice covers having a watertight insulation.

BACKGROUND OF THE INVENTION

Underground residential electric and distribution systems have primary and secondary voltage cables direct-buried in trenches, usually at curbside. To maintain the watertight integrity of these systems, all cable connectors, including splices, are insulated watertight.

Advances in rubber technology have generated the development of EPDM rubber splice covers, which are now in common use. They have largely eliminated the use of tape and various compounds for insulating splices because of the considerable installed cost for these systems. The use of EPDM rubber splice covers substantially reduces such costs. Splice covers have also been applied over splices and cables by heat-shrinking. This not only requires expensive equipment at the site, but also means that the cover must be destroyed in order to have access to the splice. Accordingly, EPDM splice covers which are slidable along the cables and the splice itself are now in use.

The splice assemblies that are the subject of this invention are generally for use on cables rated up to 600 volts. A typical splice cover has an interference fit about the cables where the ends of the splice cover meet with the cables. The interior of the splice cover, however, normally does not present an interference fit with the splice, but commonly includes an air space between the interior of the splice cover and the splice itself.

While properly designed EPDM splice covers of the type discussed above provide consistent watertight assemblies, it is important that the splice cover be installed centrally with respect to the splice. This ensures that the sealing interfaces between the splice cover and the cable insulation at each end of the splice cover are adequate to provide the required watertight seals. If the splice cover is installed off-center to the point where the bearing interface at one end of the splice cover assembly is substantially reduced in length, its watertight integrity could be impaired, resulting in failure and an electrical outage.

Accordingly, it is an object of this invention to provide a positive means of centering splice covers about splices to avoid off-center assemblies.

A further purpose of the present invention is to provide a splice and splice cover having an increased area in the splice for efficient conductance of electricity at midpoint, where current transfer is effected.

Yet another object of the invention is to provide an increased area at the splice midpoint which allows for a reduction in the areas of the splice cable entrance cylinders. The outside diameter of splices most commonly used in underground wiring can, thereby, be reduced. This permits their installation using pocket-size tools which are convenient for one-man installations in narrow trenches.

Another object of this invention is to provide a splice and splice cover having efficient conduction of heat from the splice during current overloads.

These and other objects of the invention will become obvious from the following description taken together with the drawings.

DETAILED DESCRIPTION OF THE PREFERRED EMBODIMENTS

Figure 1:
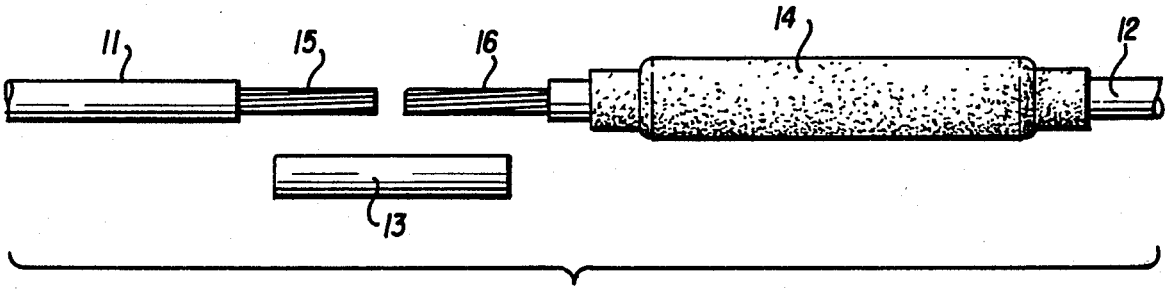
FIG. 1 (PRIOR ART)
FIG. 1 is an exploded view of a splice, splice cover, and cable of the prior art.
Figure 2:
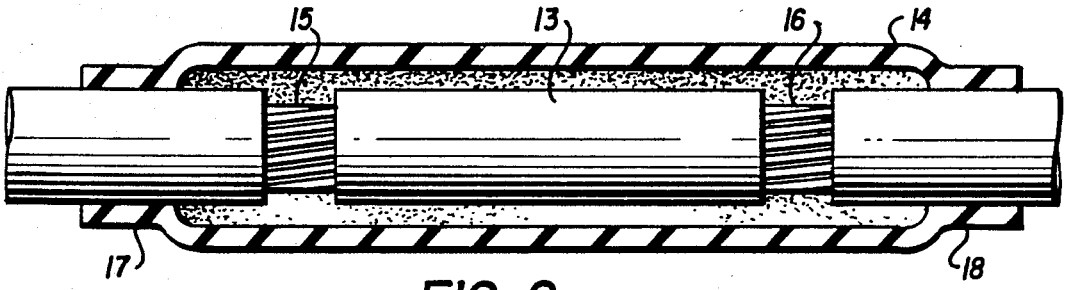
FIG. 2 (PRIOR ART)
FIG. 2 is a partial sectional view of the parts of FIG. 1 assembled.

FIGS. 1 and 2 disclose a deformable metal splice and removable splice cover used in the prior known art. In FIG. 1, insulated cables 11 and 12 are shown with a typical EPDM splice cover 14 being positioned on the insulated cable prior to assembly. Cable ends 15 and 16 are shown with the insulation removed. Splice 13 is a standard deformable metallic splice.

In FIG. 2, splice 13 has been installed on cable ends 15 and 16 and crimped, and splice cover 14 has been assembled in place over the cables and the splice. Ends 17 and 18 are of a dimension smaller than the insulated cables and, therefore, provide interference fits with the cable insulation at each end of the splice cover.

While the assembly of FIGS. 1 and 2, when properly designed, provides consistent watertight assemblies, it is important that the splice cover be installed centrally with respect to the splice. This ensures that the sealing interfaces between the splice cover and the cable insulation at each end of the splice cover are adequate to obtain the required watertight seals. If the splice cover is installed off-center to the point where the bearing interface between the cable and the splice cover at one end of the splice cover assembly is substantially reduced in length, its watertight integrity could be impaired. This could result in failure and a resultant electrical outage. The splice cover of FIGS. 1 and 2 is adjusted by eye, only, and includes no means for assuring that the cover will be centrally located over the splice.

Figure 3:
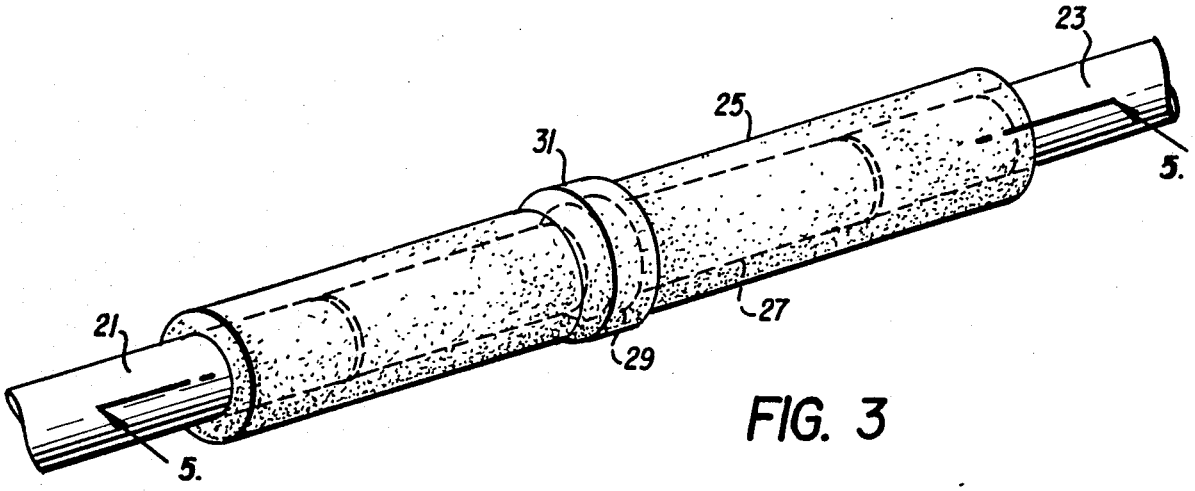
FIG. 3 is a perspective view of one of the modifications of the splice, splice cover, and cables of the present invention.
Figure 4:
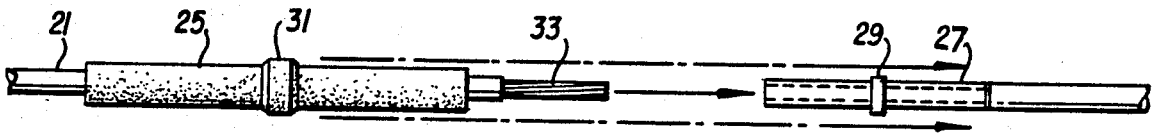
FIG. 4 is a schematic exploded view of the splice and splice cover of the present invention as shown in FIG. 3.
Figure 5:
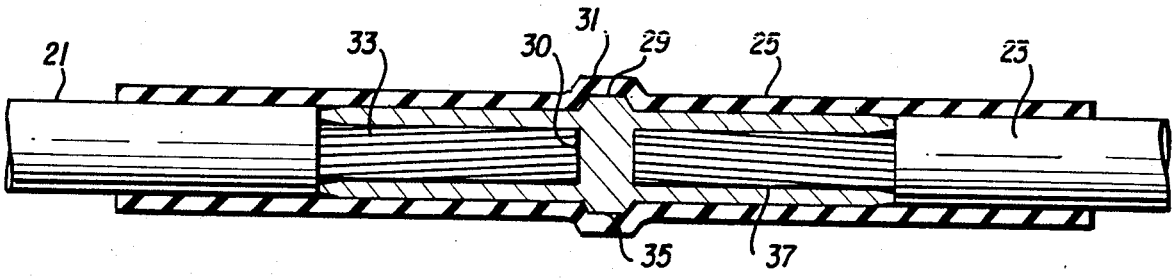
FIG. 5 is an enlarged sectional view of the splice and splice cover in the direction of line 5–5 of FIG. 3 when installed on a cable.

Turning now to FIGS. 3, 4, and 5, there is shown the structure of the present invention, which provides a positive means of centering a removable splice cover about the splice to avoid off-center assemblies. Insulated cables 21 and 23 are enclosed by the ends of splice cover 25. Splice 27 is shown in dotted lines within splice cover 25. Splice 27 includes centrally located rib 29 integral with and extending outwardly from splice 27. The splice also includes central wall 30 of substantially the same width as rib 29. A sufficient amount of insulation is cut from the cables to ensure contact of the ends 33 and 37 of the cables 21 and 23 with central wall 30. Splice cover 25 includes recess 35 extending outwardly from the interior of the splice cover, said recess having substantially the same geometrical configuration as radial rib 29 of splice 27 so as to mate therewith. The use of the recess produces a flange 31 about the exterior of splice cover 25. It should be noted that the main body of splice cover 25 has an interior diameter slightly smaller than the diameter of the main body of splice 27 and the exterior diameter of insulated cables 21 and 23. A lubricating agent is used to permit movement of the splice cover over the cable and splice. This may be applied at the time of installation or the splice cover itself may include a lubricant therein. Because of this geometrical relationship, it will be seen that an interference fit is provided over the entire area of the cable covered by the splice cover and also about the splice itself. This interference fit provides greater heat dissipation than that provided by the splice cover of FIGS. 1 and 2, which includes an air pocket. The mating of radial rib 29 and recess 35 of the splice cover ensures that the cover will be centrally located about the splice, thus eliminating the problems discussed above.

A further purpose of radial rib 29 and wall 30 as used in splice 27 is to provide an increased area for efficient conductance of electricity at mid-point, where current transfer is effected. This increased area at splice mid-point allows for a reduction in the areas of the splice cable entrance cylinders. The outside diameters of the splices can, therefore, be reduced to a size less than that of the splice sizes most commonly used in underground wiring.

These reductions in splice diameter considerably reduce the amount of compression tool pressure required during assembly. As a result, smaller, pocket-size convenience tools may be used to install larger cable sizes than that for which they were originally designed. The reduced size of the tools often permits one-man installation of the wiring in narrow trenches. Similarly, available, inexpensive, lever-type mechanical tools install splices that formerly required expensive hydraulic tools for installation.

A further advantage of the apparatus of FIGS. 3, 4, and 5 is that it provides efficient conduction of heat from the splice during current overloads over all areas of the splice, including the radial rib, since all areas have interference fits with the splice cover. Heat generated under this fault condition is thereby transferred directly to the EPDM splice cover which, being rubber, has approximately five times the conductance of air. This efficient heat transfer is not possible with splice covers presently in use, which include a considerable area of air, as shown in FIGS. 1 and 2.

The above description and drawings are illustrative, only, since variations in specific components could be made without departing from the invention, the scope of which is to be limited only by the following claims.

I claim:

1. Submersible splice apparatus for interconnecting insulated cables, said apparatus comprising a deformable metal splice having a predetermined longitudinal length;

a radial rib integral with and extending outwardly from said splice, said rib being located substantially centrally on said splice;

a resilient splice cover slidably secured about and removable from said deformable splice, said splice cover having a longitudinal length greater than the longitudinal length of said splice and having an internal diameter smaller than the external diameter of said splice so as to ensure an interference fit about said splice; and a recess extending outwardly from the interior of said splice cover, said recess having an interior dimension substantially the same as the exterior dimension of said radial rib on said splice and receiving said radial rib therein, said recess being located substantially centrally in said splice cover.

2. The submersible splice apparatus of claim 1 wherein said radial rib on said splice extends about the entire periphery of the splice and said recess in said splice cover extends about the entire inner periphery of said splice cover.

3. The submersible splice apparatus of claim 1 further comprising a metal wall located substantially centrally within and across said metal splice.

4. Submersible splice apparatus for interconnecting insulated cables, said apparatus comprising a deformable metal splice having a predetermined longitudinal length;

a metal wall located substantially centrally within and across said metal splice;

a radial rib located substantially centrally and extending outwardly about said splice;

a resilient splice cover removably secured about said deformable metal splice, said splice cover having a longitudinal length greater than the length of said splice and having an internal diameter smaller than the external diameter of said splice; and a recess extending outwardly from the interior of said splice cover and having an interior dimension substantially the same as the exterior dimension of said radial rib on said splice and receiving said radial rib therein, said recess being located substantially centrally in said splice cover, said splice cover having an interference fit about said splice.

* * * * *